United States Patent [19]

Quenot et al.

[11] 4,226,020

[45] Oct. 7, 1980

[54] KNIFE AND BLADE ADVANCE AND LOCKING MECHANISM THEREFOR

[75] Inventors: Michel C. Quenot, Ornans; Louis Scandella, Marnay, both of France

[73] Assignee: Stanley Mabo S.A., France

[21] Appl. No.: 8,586

[22] Filed: Feb. 1, 1979

[30] Foreign Application Priority Data

Feb. 1, 1978 [FR] France ..... 78 03293

[51] Int. Cl.[3] ..... B26B 1/08

[52] U.S. Cl. ..... 30/162; 30/320

[58] Field of Search ..... 30/162, 320; 30/293, 30/2

[56] References Cited

U.S. PATENT DOCUMENTS

| | | | |
|---|---|---|---|
| 3,863,339 | 2/1975 | Reaney | 30/320 |
| 3,872,591 | 3/1975 | Quenot | 30/162 |
| 4,005,525 | 2/1977 | Gringer | 30/320 |
| 4,089,112 | 5/1978 | Richards | 30/162 |
| 4,103,421 | 8/1978 | Quenot | 30/320 |

*Primary Examiner*—Jimmy C. Peters

*Attorney, Agent, or Firm*—Prutzman, Kalb, Chilton & Alix

[57] ABSTRACT

Mechanism for locking and advancing the blade of a cutting instrument.

Mechanism distinguished by a rectilinear blade-holding sheath with longitudinal slit having a series of notches on its lower edge, together with a slider to maintain the locking and the advance of the blade, said slider being molded in one piece of synthetic material comprising structures for supporting the blade, a means of elastic return, and a means of locking by a ratchet mechanism in the notches of the shaped blade-carrier.

Application: industrial manufacturing of cutting instruments, particularly of the "cutter" type.

9 Claims, 8 Drawing Figures

KNIFE AND BLADE ADVANCE AND LOCKING MECHANISM THEREFOR

This invention concerns a locking and advancing mechanism for the blade of a cutting instrument of the "cutter" type, and its application to the instrument of which it is a part.

In the cutting instruments of the "cutter" type with blade capable of being divided into sections, efforts have been made to design mechanisms for advancing the blade step by step in a wide variety of forms.

Thus, devices are available in the form of ratchets.

Sliders are known which are composed of a tooth at the extremity of a flexible curvilinear element which can engage in a triangular receiving structure formed of a succession of inclined planes. The tooth yields by pushing on the slider to engage it in the next receiving structure.

Since the force to be overcome to cause the tooth to move out of its engagement and to displace the slider is very small, the tooth disengages too easily by pulling on the slider, which may be an advantage in handling, but which becomes a genuine drawback and even a danger when cutting or cutting off great thicknesses or harder materials where the cutting motions cause the blade to come out.

The same applies to sliders equipped with a flexible metallic blade forming a loop whose bow engages in the triangular receiving structures.

The loop disengages and becomes displaced in this way from one receiving structure to the next, moving ahead one notch, i.e., the distance separating two segments of the blade.

This drawback is reduced by providing on the rear face a braking mechanism which can cause the blade to push against the opposite face of the instrument. Nevertheless, during difficult cutting, i.e. cutting which requires a greater pressure on the blade, the blade being forced out of the sleeve risks extending enough length that it breaks, thus constituting a real danger in use. Furthermore, the work cannot present the desired quality.

There exist cutting instruments of the "cutter" type with positive locking. Nevertheless, simple pressure on the control runs the risk of disengaging the catch.

In practice, this limits the use of this type of instrument solely to the domestic sector and to less resistant materials (papers, fabrics . . . ).

Instead of being able to push strongly on the handle with the thumb, the user must squeeze the handle with his hand and hold back the blade with his thumb, thus creating a very inconvenient working and pushing position.

The purpose of this invention is to remedy this drawback by providing a locking mechansim for the blade the effect of which is improved by pressure on the blade.

For this purpose, the invention is characterized by the association of a sheath whose longitudinal slit has a series of notches on the lower edge, and a one-piece molded slider presenting a surface of support and retention for the blade, a projecting part for its handling, and means of elastic pressure and engagement of one of its transverse structures in the notches.

This locking mechanism provides the cutting instrument with a number of good qualities and great safety.

First, by its ratchet locking, it comprises positive safety during all phases of utilization: the force generated towards the bottom of the notches by the top of the carriage, increases during work. In reality, the engagement improves by pressure on the base which performs the function of lever arms. This characteristic truly transforms the fitness of the "cutters", from instruments of domestic use to genuine professional tools. In other respects, the grip on the instrument becomes notably better, thus permitting precise and reliable motions. In reality, to apply great pressure, it used to be necessary to retain the blade by pushing on the slider with the thumb, which made the manipulation difficult.

Other more technical characteristics will become apparent to the reader from the following description of one type of embodiment of the invention carried out by way of non-limiting example, referring to the accompanying drawings, in which.

Figure 2:
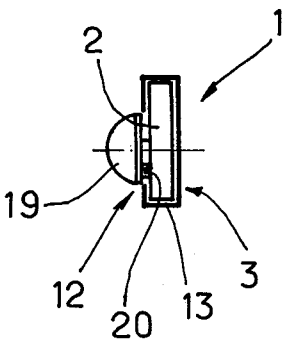
FIG. 2 is a view in transverse section of the sheath equipped with its slider.
Figure 1:
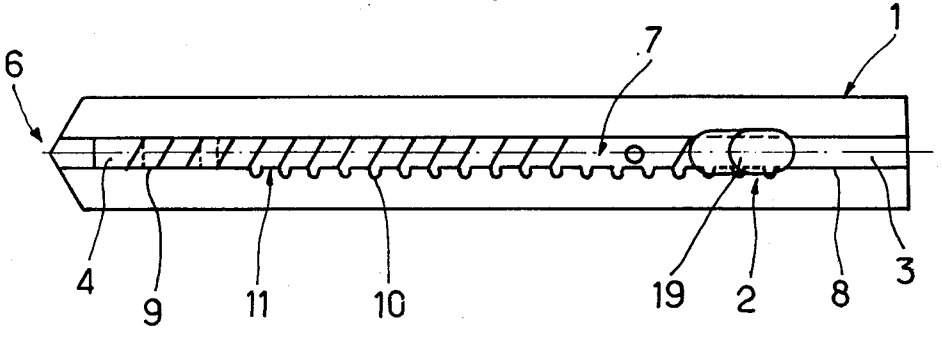
FIG. 1 is a plane view of the mechanism pursuant to the invention: sheath and slider.

The locking mechanism pursuant to the invention is composed of the combination of a rectilinear blade-holding sheath and a slider or carriage 2 serving to dirve the blade and locking it by engagement of a transverse element in the notches of the shaped blade carrier.

The sheath itself is composed of a shaped rectilinear slot with open rectangular cross section 3 with a front extremity of smaller cross section because of local narrowing by means of an inclined transitional plane 4, which at that point approaches the rear face of the forward face so as to present only a slot 5 at the point of the opening, with a cross section approximating that of the blade, so as to assure its good retention at the extremity.

The extremity of the sheath in other respects is shaped at point 6 to permit a sufficient section of the blade to come out without causing breakage along its lines of segmentation during transverse motions which are too pronounced.

This sheath on its forward face and along its entire length has a longitudinal central slit 7, provided on its lower edge between two free end zones 8 and 9, a series of notches such as 10 with rectangular opening and with semicircular bottom formed at regular intervals 11 spaced at a distance equal to the advance necessary for the blade between two consecutive segments or for a half section of blade.

This sheath serves as a sliding way and a support for the blade whose manipulation and locking are assured by the slider or carriage 2.

This has been specially designed to provide great safety in use and easy manipulation.

It comprises a one-piece injection molded body 12 of synthetic plastic, for example, polyethylene. It has a lower rectilinear edge 13 forming a slide face conforming to the bottom of the lower channel of the profiled part.

The body itself at its forward part includes a blade-holding plate 14 which has a retaining stud 15 in a central position, which engages in the hole provided in the terminal area of each blade.

This plate with a height equal to the width of the sheath, proceeds downward by a ramp 16 to constitute with the front and the base of the carriage a surface of generally triangular shape 17.

The body is prolonged towards the rear by a composite structure composed of a flat part 18 with a thickness greater than that of the plate gripping element 19 with a flat base parallel to the plane of 18 and set apart from it by a space sufficient to permit the passage of the edges of the central slit 7.

Approximately mid-way along the length of the two flat plates, a metallic stud 20 forming a means of locking is called upon to engage in the metallic notches 10 to reduce the wear.

The flat part 18 is composed of a rigid base 21 of generally rectangular shape, each of whose terminal sections carries a notch such as 22 and 23 with different depths and dimensions, connected with one another by a blade of incurvated material 24, forming an elastic return spring for good retention and for pushing the stud 20 to the bottom of the grooves 10.

This blade has vertical support arms 25 and 26 connecting it to the body and an upper part in a line broken into two lateral ramps 27 and 28 and an upper central flat section 29 assuring sufficient area of contact with the bottom of the upper groove of the sheath.

The flat part 18 is connected to the gripping element by a bridge of rectilinear material 30. This element assumes a flat shape 31 in its front part and a bulging shape 32 in its central and terminal section. This form permits the easy engagement of the extremity of the thumb at the point of transition when causing a retracting motion of the blade.

The invention is also concerned with the cutting instrument of the "cutter" type using the blade locking mechanism described above.

Figure 7:
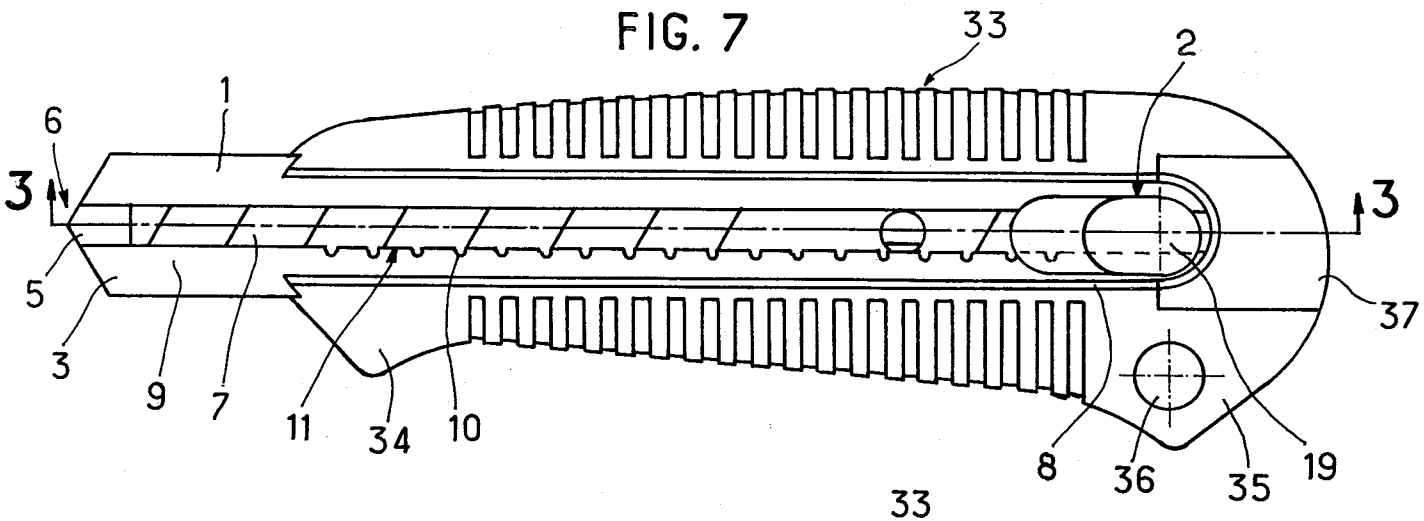
FIG. 7 is an elevation view of the sheath equipped with a handle, viewed from the front side.
Figure 8:
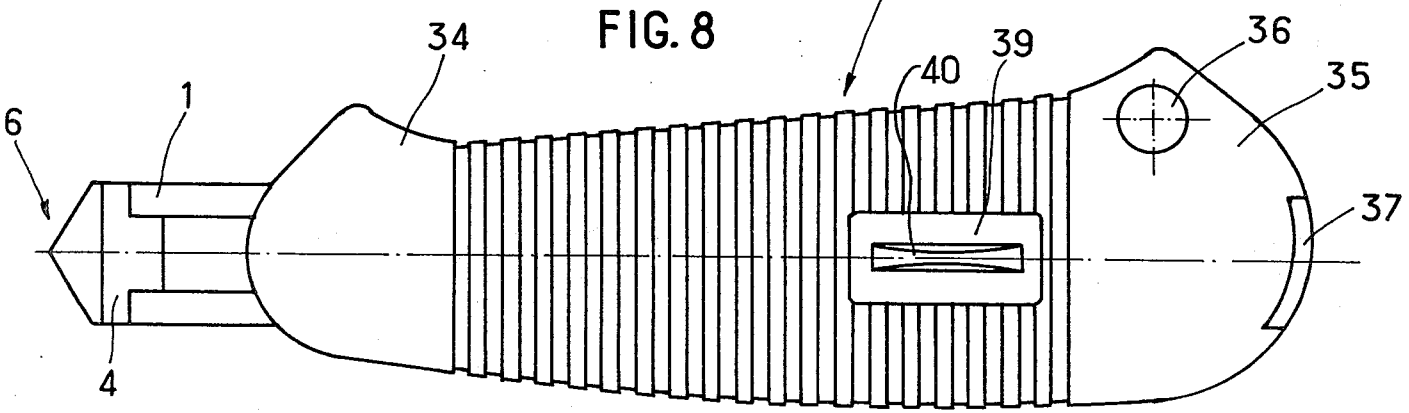
FIG. 8 is an elevation view of the sheath equipped with a handle, viewed from the rear side.

This includes a housing which encloses the sheath, preferably of plastic material such as represented in FIGS. 7 and 8.

The housing presents the general shape of a hand grip for a cutting instrument with a notched central part 33. This part serves as a gripping area between two extremities flared in their lower parts 34 and 35.

The rear extremity offers a circular passage 36 intended for tying a fastening cord or for hooking, for example, on a nail.

This housing has a removable element 37 on its rear section intended for use as a blade case and for closing. It has a lateral slit 38 in which the part of the blade to the broken off is engaged. It is adapted to the housing and assures the curvilinear continuity of the extremity.

Figure 3:
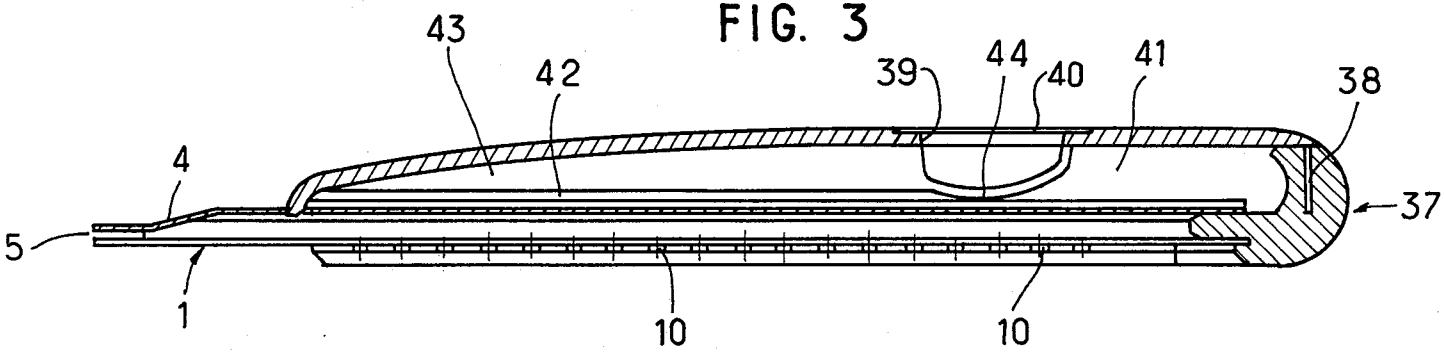
FIG. 3 is a view in longitudinal section of the sheath in its handle taken along line 3—3 of FIG. 7.
Figure 4:
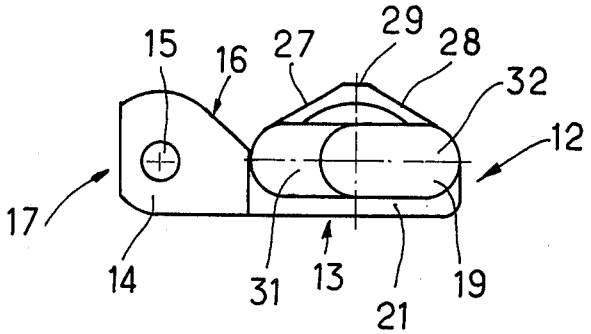
FIG. 4 is a front elevation view of the slider.
Figure 5:
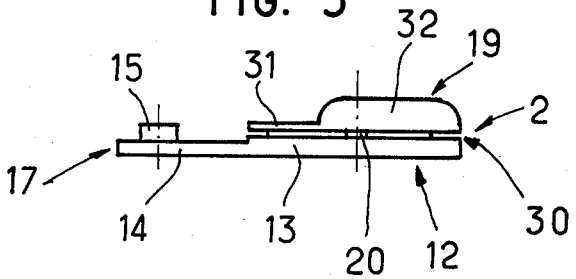
FIG. 5 is a plane view of the slider.
Figure 6:
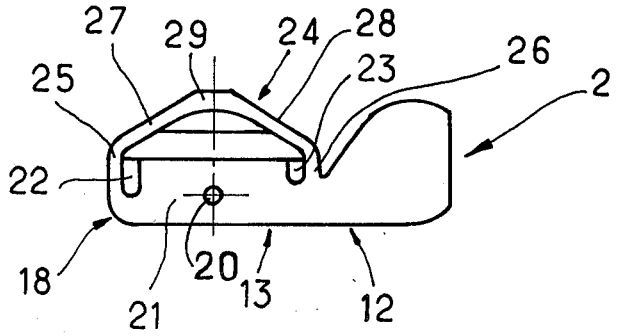
FIG. 6 is a rear elevation view of the slider.

The housing on its rear face has a window 39 for access to its interior, closed by a plate 40 serving as a push-button. As shown in FIG. 3, the interior structure of the housing has a cavity 41 defined by the rear face of the sheath, the housing, and the blade case element.

This cavity serves for storage of the replacement blades 42 which are found laid up against the rear face between the interior wall 43 and the interior incurvated part 44 of the internal push-button element.

In order better to understand the invention, hereinafter the operation of the mechanism pursuant to the invention and of the cutting instrument will be illustrated.

The changing of the blade is carried out from the rear by disengaging the extremity forming the blade case.

Access is thus made possible to the profiled blade carrier or sheath and to the storage area.

At the time of the exchange, the blade is engaged by the rear and the slider is raised by pressing the blade-carrying plate on its rear extremity, engaging the lug in the circular opening of the blade.

The blade progresses in the sheath, and the slider is introduced into it, which runs freely until it comes in contact with the first notch, which for safety reasons does not correspond to a position with the blade extended.

Depending on the depth of cut desired, the mechanism is moved along by one or several notches, and the blade moves out from the front extremity of the sheath.

When the cutting edge of the segment in use becomes dull, it is broken off, which is done easily along a segment with the help of the blade case closing off the rear part of the instrument.

Because of this mechanism, it becomes possible to cut harder materials and materials with greater thicknesses in a simple and flawless manner with full safety.

Although one embodiment of the invention has just been described, it is understood that it is not thereby limited in any way and that diverse variations and modifications of a secondary order or substitution by equivalent elements remain within its scope.

We claim:

1. A knife comprising an elongated tubular blade-carrying sheath open at one end and having a longitudinally extending slot in the front wall thereof, a blade having a cutting edge on a longitudinal edge of the blade and being disposed within the sheath for relative longitudinal sliding movement, a combined sliding and locking member having means for releasably mounting one end of the blade with the cutting edge directed downwardly, the lower edge of the slot having a series of longitudinally spaced notches, a detent on said member selectively engageable with said notches for locking said member in adjusted position, said member having a biasing means for biasing the member downwardly to urge said detent into a notch, the detent being disengaged from a notch when the member is lifted upwardly against the bias of said biasing means.

2. The mechanism of claim 1 characterized by the fact that said member has a pair of downwardly depending side walls straddling the lower edge of said slot and the detent is disposed therebetween.

3. The mechanism of claim 1 characterized by the fact that the side walls of the notches are perpendicular to the longitudinal axis of the sheath.

4. The mechanism of claim 2 characterized by the fact that said member has a molded plastics body with a gripping element formed on the outer depending wall to project from said slot.

5. The mechanism of claim 1 or 2 wherein the biasing means is integral with said member.

6. The mechanism according to claim 2 wherein a bridge of material connects said depending walls, the bridge having a height less than the height of the slot sufficient to permit the detent to be lifted upwardly to disengage the notches.

7. The mechanism of claim 1 wherein the sheath is mounted in a molded hand grip.

8. The mechanism of claim 7 wherein the molded hand grip is spaced from the back wall of the sheath to form a blade storage chamber.

9. The mechanism of claim 7 wherein the sheath and detent are formed of metal.

* * * * *